US007934399B2

(12) United States Patent
No et al.

(10) Patent No.: US 7,934,399 B2
(45) Date of Patent: May 3, 2011

(54) DRUM TYPE WASHING MACHINE

(75) Inventors: Yang Hwan No, Changwon-si (KR); Jong Min Kim, Changwon-si (KR); Han Ki Cho, Changwon-si (KR); Ho Sung Jang, Gyeongsangnam-do (KR); Dong Hoon Kang, Busan (KR); Jung Hoon Kang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 463 days.

(21) Appl. No.: 10/555,435

(22) PCT Filed: Jun. 17, 2005

(86) PCT No.: PCT/KR2005/001860

§ 371 (c)(1),
(2), (4) Date: Apr. 12, 2007

(87) PCT Pub. No.: WO2006/001617

PCT Pub. Date: Jan. 5, 2006

(65) Prior Publication Data

US 2007/0193311 A1 Aug. 23, 2007

(30) Foreign Application Priority Data

Jun. 25, 2004 (KR) ..... 10-2004-0048085

(51) Int. Cl.
*D06F 37/26* (2006.01)

(52) U.S. Cl. ..... 68/3 R; 68/13 R

(58) Field of Classification Search ..... 68/3 R, 68/12.01, 12.23, 12.27, 13 R
See application file for complete search history.

(56) References Cited

U.S. PATENT DOCUMENTS

| | | | | |
|---|---|---|---|---|
| 3,253,874 | A * | 5/1966 | Czech | 312/265.5 |
| 4,288,133 | A | 9/1981 | Deatherage | |
| 4,798,424 | A * | 1/1989 | Coates et al. | 312/257.1 |
| 5,001,308 | A * | 3/1991 | Mori | 200/5 A |
| 5,584,563 | A * | 12/1996 | Stottmann | 362/85 |
| 5,611,609 | A * | 3/1997 | Katz et al. | 312/263 |
| 5,611,610 | A * | 3/1997 | Katz et al. | 312/263 |
| 5,694,793 | A * | 12/1997 | Nishimura et al. | 68/12.27 |
| 6,119,678 | A * | 9/2000 | Marchand | 126/39 B |
| 7,557,776 | B2 * | 7/2009 | Inoue et al. | 345/60 |
| 2004/0150303 | A1 | 8/2004 | Park et al. | |
| 2005/0183471 | A1 * | 8/2005 | Kang et al. | 68/12.27 |

FOREIGN PATENT DOCUMENTS

| | | |
|---|---|---|
| DE | 83 33 066 | 4/1984 |
| DE | 10051075 (A1) | 4/2002 |

* cited by examiner

*Primary Examiner* — Joseph L Perrin
(74) *Attorney, Agent, or Firm* — McKenna Long & Aldridge LLP

(57) ABSTRACT

A control panel of a drum type washing machine is disclosed. The present invention includes a cabinet, a control panel assembled to the cabinet, a plurality of operational buttons provided to the control panel, a deco panel assembled to the control panel, and a display unit provided to the deco panel. Accordingly, the present invention facilitates the deco panel to be assembled to the control panel despite a flesh formed on a rim of the deco panel and sustains the assembled state.

9 Claims, 3 Drawing Sheets

[Fig. 2]
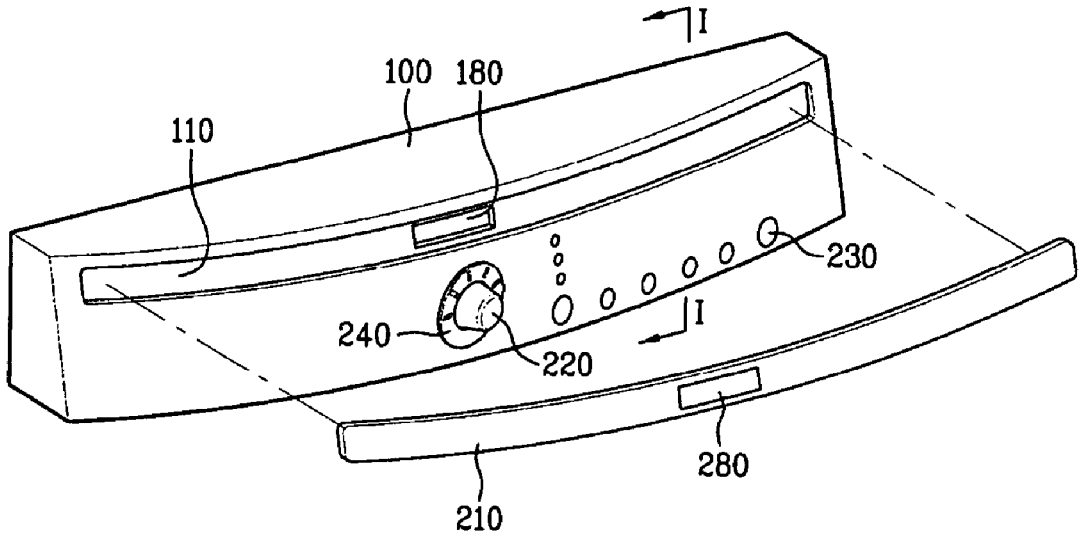

[Fig. 3]
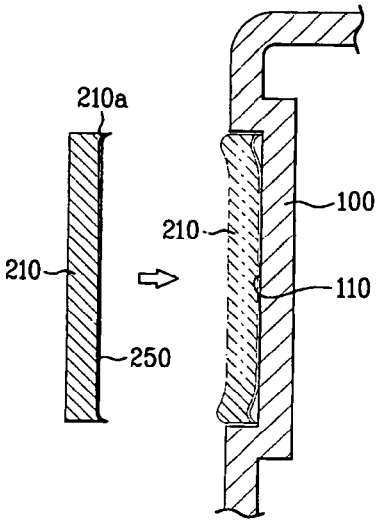
[Fig. 4]
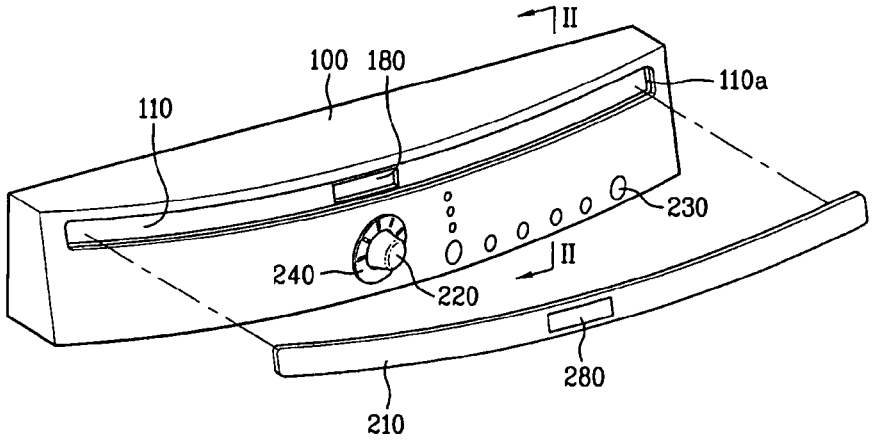
[Fig. 5]
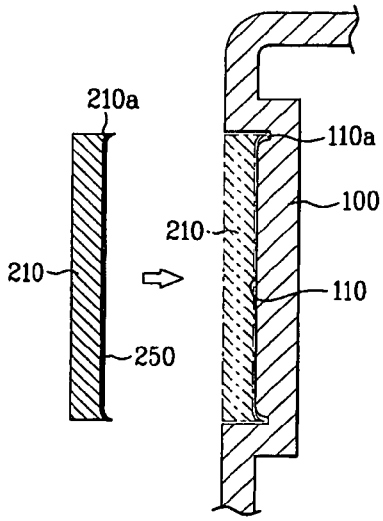

DRUM TYPE WASHING MACHINE

This application claims priority to International Application No. PCT/KR2005/001860 filed on Jun. 17, 2005, as well as Korean Application P 2004-48085 filed on Jun. 25, 2004, which is incorporated by reference, as if fully set forth herein.

TECHNICAL FIELD

The present invention relates to a drum type washing machine, and more particularly, to a drum type washing machine having a control panel provided with a deco panel.

BACKGROUND ART

Generally, a drum type washing machine performs washing using a frictional force between a drum and laundry in a manner of rotating the drum accommodating the laundry, water and detergent by a drive force of a motor. So, the drum type washing machine causes almost no damage to the laundry, prevents the laundry from being raveling with each other, and brings about the rubbing and beating effects in washing.

FIG. 1 is a perspective diagram of a drum type washing machine according to a related art.

Referring to FIG. 1, an exterior body of a drum type washing machine consists of a hexahedral cabinet 3 in general. A door 2 is provided to a front side of the cabinet 3 to put/pull out a laundry in/from the cabinet 3.

A control panel 10 is provided to an upper front part of the cabinet 3 forming an exterior of the drum type washing machine. The control panel 10 consists of a plurality of buttons 23 and a rotary knob 22 for washing control function inputs made by a user and a display window 18 displaying a remaining time, a washing situation and the like.

A plurality of the buttons 23 and the rotary knob 22 are operated as input devices for actuating the washing machine in selecting a washing time, a washing course, a dewatering course and a drying course. So, a user operates the respective buttons 23 and the rotary knob 22 to input a user-specific washing course, time and the like.

The display window 18 informs a user of various kinds of washing information such as a washing progress state, a remaining time and the like via characters and symbols.

A circumference of the rotary knob 22 is enclosed by a deco 24 in which a prescribed lamp (not shown in the drawing) is built. And, the rotary knob 22 is installed at the control panel 10.

However, the related art control panel having a plain exterior needs to be improved.

Namely, the related art control panel lacks in stimulating the user's sensitivity for the distinction from other manufacturer's products. Hence, the demand for manufacturing a product falling under a consumer's notice rises.

DISCLOSURE OF THE INVENTION

Accordingly, the present invention is directed to a drum type washing machine that substantially obviates one or more of the problems due to limitations and disadvantages of the related art.

An object of the present invention is to provide a drum type washing machine, in which a metal-based deco panel having a display unit is provided to a control panel attached to the drum type washing machine to decorate an exterior of the control panel and by which the control panel is distinguished from other manufacturers' products.

Another object of the present invention is to provide a drum type washing machine, by which an assembly between a deco panel and a control panel is stably facilitated.

Additional features and advantages of the invention will be set forth in the description which follows, and in part will be apparent from the description, or may be learned by practice of the invention. The objectives and other advantages of the invention will be realized and attained by the structure particularly pointed out in the written description and claims thereof as well as the appended drawings.

To achieve these and other advantages and in accordance with the purpose of the present invention, as embodied and broadly described, a drum type washing machine according to the present invention includes a cabinet, a control panel assembled to the cabinet, a plurality of operational buttons provided to the control panel, a deco panel assembled to the control panel, and a display unit provided to the deco panel.

To further achieve these and other advantages and in accordance with the purpose of the present invention, a drum type washing machine includes a control panel and a loading recess provided to a front side of the control panel so that a deco panel is attached to the loading recess, wherein escaping grooves are provided to four edges of the loading recess to which the deco panel is attached to prevent an interference with a flesh generated from forming the deco panel.

Therefore, the present invention facilitates the deco panel having the flash to be attached to the control panel to enable an exterior distinguishable from other manufacturers' products and to enable stable attachment of the deco panel to the control panel, whereby the deco panel is prevented from being separated from the control panel after duration.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings:

FIG. 2 is an exploded perspective diagram of a control panel to which a deco panel is attached in a drum type washing machine according to one embodiment of the present invention;

FIG. 3 is a cross-sectional diagram of the assembled control and deco panels taken along a cutting line I-I in FIG. 2;

FIG. 4 is an exploded perspective diagram of a control panel to which a deco panel is attached in a drum type washing machine according to another embodiment of the present invention;

FIG. 5 is a cross-sectional diagram of the assembled control and deco panels taken along a cutting line II-II in FIG. 4.

BEST MODE FOR CARRYING OUT THE INVENTION

Figure 1:
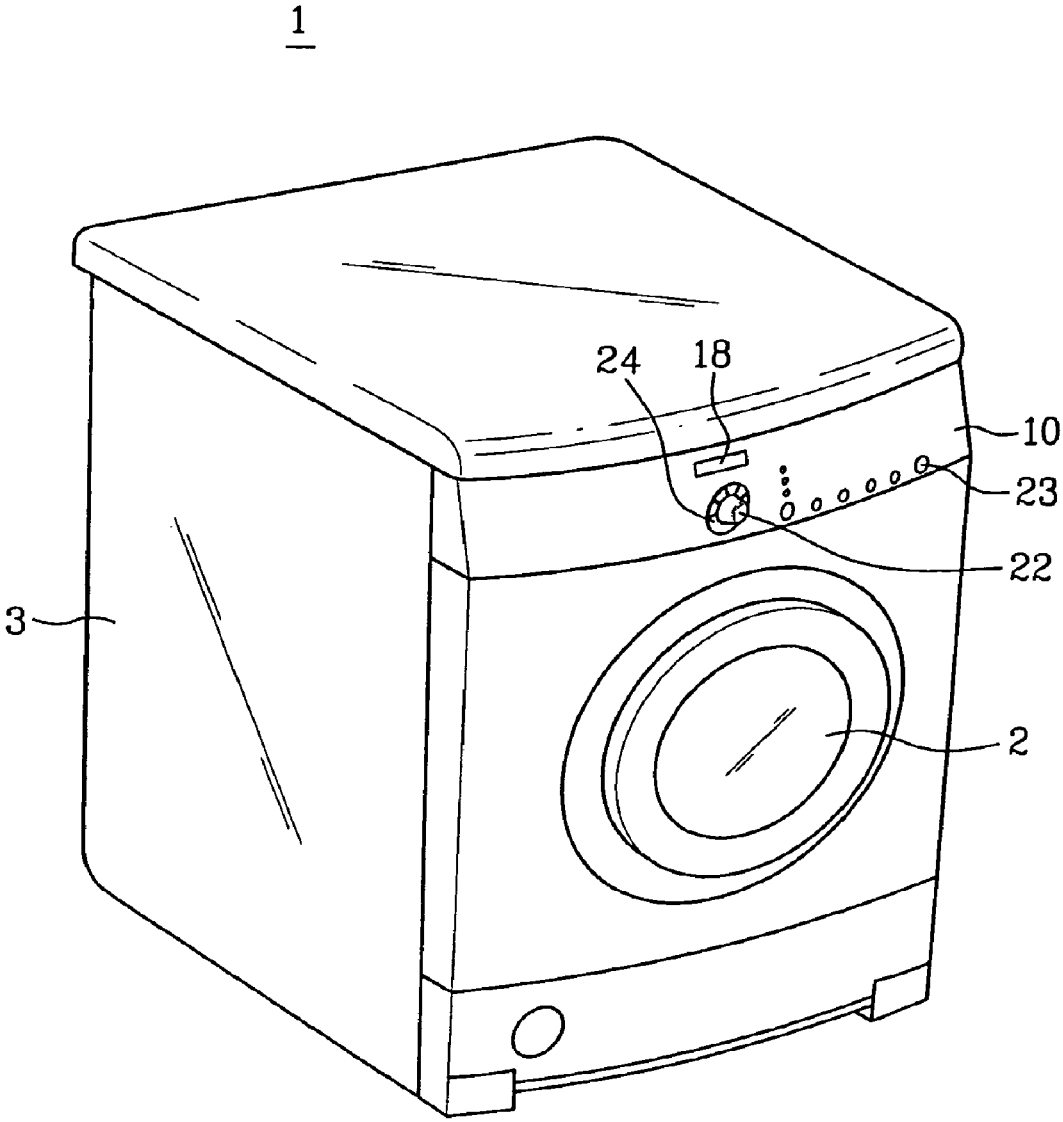
FIG. 1 RELATED ART
FIG. 1 is a perspective diagram of a drum type washing machine according to a related art.

Reference will now be made in detail to the preferred embodiments of the present invention, examples of which are illustrated in the accompanying drawings.

FIG. 2 is an exploded perspective diagram of a control panel to which a deco panel is attached in a drum type washing machine according to one embodiment of the present invention.

Referring to FIG. 2, FIG. 1, a control panel 100 is provided to an upper part of a cabinet 3 (cf. FIG. 1) forming an exterior of a body of a drum type washing machine. The control panel 100 includes a plurality of buttons 230 and a rotary knob 220 for washing control function inputs made by a user and a display window 180.

In this case, a plurality of the buttons 230 and the rotary knob 220 are operated as input devices for actuating the washing machine in selecting a washing time, a washing course, a dewatering course and a drying course. So, a user operates the respective buttons 230 and the rotary knob 220 to input a user-specific washing course, time and the like.

A circumference of the rotary knob 220 is enclosed by a deco 240 in which a prescribed lamp (not shown in the drawing) is built. And, the rotary knob 220 is installed at the control panel 100.

In this case, a deco panel 210 having a display unit 280 is provided to the control panel 100 of the drum type washing machine according to the present invention.

It is a matter of course that the display unit 280 of the deco panel 210 is configured to coincide with the display window 180 of the control panel 100.

In particular, the deco panel 210 is formed of a metal-based sheet.

And, the deco panel 210 is configured in a length direction across a right-to-left front side of the control panel 100.

A loading recess 110 is provided to the control panel 100 so that the deco panel 210 can be loaded in the loading recess 110. And, the display unit 280 informs a user of various kinds of washing information such as a washing progress state, a remaining time and the like via characters and symbols on the display window 180 of the control panel 100.

FIG. 3 is a cross-sectional diagram of the assembled control and deco panels taken along a cutting line I-I in FIG. 2.

Referring to FIG. 3, the deco panel 210 formed of the metal-based material is manufactured by pressing. In this case, a prescribed flesh 210*a* is formed on a rim of the deco panel 210 cut by the pressing.

A process of assembling the control panel and the deco panel together in the drum type washing machine according to one embodiment of the present invention is explained as follows.

First of all, the deco panel 210 is assembled to the loading recess 110 of the control panel 100 using a two-side adhesive tape 250.

The attached deco panel 210 decorates an exterior of the control panel 100.

In assembling the deco panel 210 having the flesh 210*a* to the loading recess 110 of the control panel 100, the deco panel 210, as shown in FIG. 3, gets wrinkled to make the assembly unstable.

Namely, the deco panel 210 can be easily separated from the loading recess 110. If the deco panel 210 is partially detached from the loading recess 110, it may happen that the deco panel 210 is gradually separated from the control panel 100 along its length direction to be entirely separated from the control panel 100.

To solve such a problem, another embodiment of the present invention is proposed as follows.

FIG. 4 is an exploded perspective diagram of a control panel to which a deco panel is attached in a drum type washing machine according to another embodiment of the present invention.

Referring to FIG. 4, a control panel 100 including a loading recess 110, in which a deco panel 210 is loaded, and an escaping groove 110*a* formed on edges of the loading recess 110.

In this case, the escaping groove 110*a* can be provided to upper and lower edges of the loading recess 110, to right and left edges of the loading recess 110 or the entire edges of the loading recess 110.

The deco panel 210, as shown in FIG. 5, is assembled to the control panel 100 using a two-side adhesive tape 250, an adhesive agent or the like.

To prevent the deco panel 210 from being externally projected due to the thickness of the two-side adhesive tape 250 or the adhesive agent, it is preferable that a depth of the loading recess 110 is formed greater than a thickness of the deco panel 210.

Preferably, a depth of the escaping groove 110*a*, like the cross-sectional diagram shown in FIG. 5, is formed greater than a length of a flesh 210*a* formed at the deco panel 210.

A width of the escaping groove 110*a*, as shown in FIG. 5, is preferably formed greater than a maximal thickness of the flesh 210*a* formed in performing a pressing process of the deco panel 210.

An assembly process and operation of the above-configured control panel of the drum type washing machine according to another embodiment of the present invention is explained as follows.

First of all, the deco panel 210 is assembled to the loading recess 110 of the control panel 100 using the two-side adhesive tape 250 or the adhesive agent.

And, the flesh 210*a* of the deco panel 210 is fitted in the escaping groove 110*a* provided to the loading recess 110.

If so, the deco panel 210 can be directly assembled to the loading recess 110 without being wrinkled or modifying its exterior. After completion of the assembly, one side of the deco panel 210 is entirely brought into contact in plane with the loading recess 110 to provide an excellent assembled state.

Therefore, the exterior of the assembly looks neat. And, it is able to prevent the deco panel from being entirely separated from the loading recess even if the deco panel is partially detached from the loading recess after duration.

INDUSTRIAL APPLICABILITY

Accordingly, by providing the deco panel to the control panel of the drum type washing machine, the present invention can be distinguished from other manufacturers' products and provide the decorated control panel.

And, even if the flesh is formed on the rim of the deco panel in assembling the deco panel, the loading recess previously provided to the control panel facilitates the stable assembly thereof to provide the excellent assembled state.

Moreover, since the deco panel is stably assembled to sustain the excellent assembled state, it is able to prevent the deco panel from being gradually separated from the loading recess after duration.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

The invention claimed is:

1. A drum type washing machine comprising:

a cabinet;

a control panel assembled to the cabinet, having a plurality of operational buttons, a loading recess and a display window provided in the loading recess for displaying washing information;

a deco panel assembled to a front side of the control panel and having a display unit which is configured to coincide with the display window, wherein the loading recess is provided to the front side of the control panel so that the deco panel is loaded on the loading recess, and an escaping groove is provided to the loading recess to avoid an interference with a flesh formed on a rim of the deco panel.

2. The drum type washing machine of claim 1, wherein the control panel further comprises a rotary knob for setting a washing course and the like.

3. The drum type washing machine of claim 1, wherein the deco panel is configured in a length direction across a right-to-left direction of the control panel.

4. The drum type washing machine of claim 1, wherein the deco panel is attached to the loading recess by a two-side adhesive tape.

5. The drum type washing machine of claim 1, wherein a depth of the escaping groove is formed greater than a length of the flesh formed on the deco panel.

6. The drum type washing machine of claim 1, wherein a width of the escaping groove is formed greater than a maximal thickness of the flesh formed on the deco panel.

7. The drum type washing machine of claim 1, wherein the escaping groove is provided to upper and lower edges of the loading recess.

8. The drum type washing machine of claim 1, wherein the escaping groove is provided to right and left edges of the loading recess.

9. The drum type washing machine of claim 1, wherein a depth of the loading recess is formed greater than a thickness of the deco panel.

* * * * *